US008523749B2

(12) United States Patent
Sudhues et al.

(10) Patent No.: US 8,523,749 B2
(45) Date of Patent: Sep. 3, 2013

(54) THREE-PHASE SOLID BOWL SCREW CENTRIFUGE AND METHOD OF CONTROLLING THE SEPARATING PROCESS

(75) Inventors: Wolf-Diethard Sudhues, Bocholt (DE); Tore Hartmann, Oelde (DE); Ulrich Horbach, Hamm (DE)

(73) Assignee: GEA Mechanical Equipment GmbH, Oelde (DE)

( * ) Notice: Subject to any disclaimer, the term of this patent is extended or adjusted under 35 U.S.C. 154(b) by 828 days.

(21) Appl. No.: 11/922,144

(22) PCT Filed: May 31, 2006

(86) PCT No.: PCT/EP2006/005172

§ 371 (c)(1),
(2), (4) Date: Nov. 25, 2009

(87) PCT Pub. No.: WO2006/133804

PCT Pub. Date: Dec. 21, 2006

(65) Prior Publication Data

US 2010/0105536 A1 Apr. 29, 2010

(30) Foreign Application Priority Data

Jun. 14, 2005 (DE) ..... 10 2005 027 553

(51) Int. Cl.
*B04B 1/20* (2006.01)
*B04B 11/08* (2006.01)

(52) U.S. Cl.
USPC ..... 494/25; 494/53; 494/56

(58) Field of Classification Search
USPC ..... 494/23, 25, 26, 53, 54, 56, 67, 7–9; 210/380.1, 380.3
See application file for complete search history.

(56) References Cited

U.S. PATENT DOCUMENTS

| | | | | |
|---|---|---|---|---|
| 3,885,734 | A * | 5/1975 | Lee | 494/25 |
| 4,042,172 | A | 8/1977 | Nozdrovsky | |
| 4,525,155 | A | 6/1985 | Nilsson | |
| 5,176,616 | A * | 1/1993 | Schlip et al. | 494/37 |
| 5,217,428 | A | 6/1993 | Schip et al. | |

(Continued)

FOREIGN PATENT DOCUMENTS

| | | |
|---|---|---|
| CA | DE 30 14 315 | 10/1981 |
| CA | 1 180 195 | 1/1985 |

(Continued)

*Primary Examiner* — Charles E Cooley
(74) *Attorney, Agent, or Firm* — Barnes & Thornburg LLP

(57) ABSTRACT

A three-phase solid bowl screw centrifuge includes a rotatable drum, a screw arranged in the drum, a solid material discharge located at the fist axial end of the drum, and two liquid outlets are located at a second axial end of the drum. A first of the liquid is for a lighter liquid phase and a second of the liquid outlets is for a heavier liquid phase. One of the liquid outlets includes a skimmer disk arranged in a skimmer chamber and the other of the liquid outlets is formed as an overflow. Two regulating disks are located in the front of the skimmer disk. The regulating disks extend radially from an outside of the drum toward an inside of the drum. A siphon disk extends between the regulating disks and into the skimmer chamber from a interior circumference of the skimmer chamber to an exterior circumference of the skimmer chamber. An annular chamber is formed during an operation and is located between the siphon disk and the skimmer disk.

16 Claims, 8 Drawing Sheets

(56) References Cited

U.S. PATENT DOCUMENTS

| | | | | |
|---|---|---|---|---|
| 5,244,451 | A * | 9/1993 | Retter | 494/37 |
| 5,593,377 | A | 1/1997 | Figgener et al. | |
| 5,643,169 | A | 7/1997 | Leung et al. | |
| 5,695,442 | A | 12/1997 | Leung et al. | |
| 5,885,202 | A * | 3/1999 | Ostkamp | 494/25 |
| 7,056,273 | B2 * | 6/2006 | Ostkamp et al. | 494/27 |
| 7,083,565 | B2 * | 8/2006 | Hermeler et al. | 494/53 |
| 7,326,169 | B2 | 2/2008 | Brüning et al. | |
| 7,510,519 | B2 * | 3/2009 | Reichenbach et al. | 494/57 |
| 2005/0164861 | A1 | 7/2005 | Bruning et al. | |
| 2005/0227848 | A1 * | 10/2005 | Ostkamp et al. | 494/53 |
| 2008/0153687 | A1 * | 6/2008 | Reichenbach et al. | 494/56 |
| 2010/0041535 | A1 * | 2/2010 | Horbach et al. | 494/5 |
| 2010/0105536 | A1 * | 4/2010 | Sudhues et al. | 494/26 |
| 2010/0144508 | A1 * | 6/2010 | Ridderstrale et al. | 494/50 |
| 2012/0040443 | A1 * | 2/2012 | Wase et al. | 435/271 |

FOREIGN PATENT DOCUMENTS

| | | | |
|---|---|---|---|
| DE | 1 220 012 | | 6/1966 |
| DE | 26 17 692 | A1 | 11/1977 |
| DE | 27 07 111 | A1 | 8/1978 |
| DE | 37 28 901 | C1 | 11/1988 |
| DE | 38 22 983 | A1 | 1/1990 |
| DE | 39 21 327 | A1 | 1/1991 |
| DE | 41 32 029 | A1 | 4/1993 |
| DE | 195 00 600 | C1 | 2/1996 |
| DE | 696 20 500 | | 11/2002 |
| DE | 102 03 652 | A1 | 8/2003 |
| DE | 102 09 925 | A1 | 9/2003 |
| DE | 10 223 802 | A1 | 12/2003 |
| EP | 0 123 491 | A2 | 10/1984 |
| EP | 0 702 599 | B1 | 3/1996 |
| EP | 1 044 723 | A1 | 10/2000 |
| GB | 1 569 520 | | 6/1980 |
| WO | WO 86/01436 | | 3/1986 |
| WO | WO 96/34693 | | 11/1996 |
| WO | WO 02/05966 | A2 | 1/2002 |
| WO | WO 02/062483 | A1 | 8/2002 |
| WO | WO 2004082844 | A1 * | 9/2004 |
| WO | WO 2006/096113 | A1 | 9/2006 |

* cited by examiner

THREE-PHASE SOLID BOWL SCREW CENTRIFUGE AND METHOD OF CONTROLLING THE SEPARATING PROCESS

BACKGROUND

The present disclosure relates to a three-phase solid bowl screw centrifuge, or three-phase decanter having a rotatable drum, a screw arranged in the drum, a solid material discharge located at a first axial end of the drum, and two liquid outlets located at a second axial end of the drum. A first of the liquid outlets is for a lighter liquid phase and a second of the liquid outlets is for a heavier liquid phase. One of the liquid outlets includes a skimmer disk arranged in a skimmer chamber and the other of the liquid outlets is formed as an over flow. The present disclosure also relates to a method for operating or controlling the separating process by a centrifuge as just described.

With respect to the state of the art, the following documents are relevant: U.S. Pat. No. 3,623,656, International Patent Document WO 03/074 185 A1; German Patent Documents DE 195 00 600 C1, DE 102 23 802 A1, DE 38 22 983 A1; International Patent Document WO 02/062483 A1; and, German Patent Document DE 26 17 692 A1.

U.S. Pat. No. 3,623,656 shows a three-phase decanter by which two liquid phases and one solid phase can be discharged from the drum. When the machine is stopped, the liquid outlets can be adjusted by a conversion.

International Patent Document WO 03/074 185 A1 shows a three-phase decanter by which also two liquid phases and one solid phase can be discharged from the drum. The outflow quantity of the heavier liquid phase can be adjusted by a weir.

German Patent Document DE 38 22 983 A1 illustrates a three-phase decanter by which also two liquid phases and one solid phase can be discharged from the drum, one liquid phase being discharged through a weir and the other being discharged through a skimmer disk.

German Patent Documents DE 195 00 600 C1 and DE 102 23 802 A1 indicate two-phase decanters where the liquid is discharged by a skimmer disk, or centripetal, from a chamber.

International Patent Document WO 02/062483 A1 shows a method of operating a solid bowl screw centrifuge.

German Patent Document DE 26 17 692 A1 discloses a solid bowl screw centrifuge having several disk stacks consisting of separating disks and several screw areas.

In the case of three-phase separating decanters, as a rule, conversion parts are available for the adaptation to the respective product characteristics or for the adaptation of the process to the respective situations.

If, for example, during the process of obtaining olive oil in a three-phase operation, the product characteristics of the olive change from the start to the end of the harvest, it may be necessary to stop the processing, to remove the rotor and to install other regulating disks and/or regulating tubes. This is time-consuming and cost-intensive.

It has been suggested to regulate the heavier phase by a non-rotating throttle disk arranged outside the drum and to discharge the lighter phase by a skimmer disk, or centripetal pump. Although this construction has been successful, it requires at least the use of a displaceable throttle disk from a constructive point of view.

However, by varying the throttling at the skimmer disk, or centripetal pump, alone, the process cannot be sufficiently adjusted to the product characteristics, in order to avoid a conversion.

With respect to the above, the present disclosure relates to reducing the constructive expenditures for creating a three-phase decanter that is easily adaptable to changing product characteristics and of indicating an advantageous method for its operation.

The present disclosure relates to a three-phase solid bowl screw centrifuge comprised as follows.

A rotatable drum, a screw arranged in the drum, a solid material discharge located at a first axial end of the drum, and two liquid outlets located at a second axial end of the drum. A first of the liquid outlets is for a lighter liquid phase and a second of the liquid outlets is for a heavier liquid phase. One of the liquid outlets includes a skimmer disk arranged in a skimmer chamber and the other of the liquid outlets is formed as an overflow. Two regulating disks are located in front of the skimmer disk and extend radially from an outside of the drum toward an inside of the drum. A siphon disk extends between the regulating disks and into the skimmer chamber from an interior circumference of the skimmer chamber to an exterior circumference of the skimmer chamber. An annular chamber is formed during an operation and is located between the siphon disk and the skimmer disk. The siphon disk and skimmer disk act as axial boundaries for an axial area, and the annular chamber is further located between an inside radius of the lighter liquid phase in the axial area and an inner wall of the skimmer chamber in the axial area. A fluid feed pipe leads into the annular chamber to change a pressure on the annular chamber and to change at least one of a separation zone between the lighter and heavier phases and/or a pool depth in the drum. A feed pipe and a removal pipe for feeding fluid to the chamber and removing it from the chamber may also be provided.

As a result of a change of pressure in the annular chamber, as required, in connection with a throttling effect onto the skimmer disk, or centripetal pump, the separating zone in the drum can easily be shifted, which also results in a change of the liquid level. A conversion, which would otherwise be required as a result of changes of the characteristics of the product, as a rule, can be eliminated by utilizing the given regulating range. The constructive expenditures for providing the annular chamber are low.

As suggested above, the annular chamber, preferably, has a fluid pipe for feeding a fluid, particularly a gas, into the annular chamber, as a device for changing the pressure in the annular chamber.

The overflow for the other phase can be implemented by radial discharge pipes, which penetrate the drum shell or the drum lid.

This basic construction can be implemented particularly in two variants. In one variant, the heavier liquid phase is discharged through the discharge pipe and the lighter liquid phase is discharged through the skimmer disk, or centripetal pump. In the other variant, the lighter liquid phase is discharged through the discharge pipe and the heavier liquid phase is discharged through the skimmer disk. Both variants permit a good controlling of the process but result in different regulating characteristics.

The present disclosure also relates to a process for operating a three-phase solid bowl screw centrifuge. The regulating of the separating operation in the drum takes place in a very simple manner by changing the pressure in the annular chamber as the manipulated variable. This variant may be preferred because a simple and good regulating of the separating operation becomes possible.

As an alternative, it is also conceivable that the regulating of the separating operation in the drum takes place by changing the rotational speed of the drum as the manipulated variable.

The regulating of the separating operation in the drum may also take place as a function of the concentration in the solid phase or in one or both discharged liquid phases as the controlled variable.

The embodiments of the present disclosure are also suitable for the phase separation when obtaining hydrometals, such as cobalt, nickel, copper.

When obtaining hydrometals, such as cobalt, nickel, copper, the emulsion formation cannot be avoided during the extraction. The extraction, as well as the emulsion, includes three phases: an organic phase; an aqueous phase; and a solids phase. The open sedimentation tanks of the extraction are susceptible to contamination from the air. These different dust concentrations lead to a density difference of the individual phases in the emulsion. The decanter, according to the present disclosure, provides a remedy.

In order to meet these dynamic process demands, the separating diameter within the decanter can be adapted on-line by an increase of pressure into the annular chamber. As a result, the emulsion is cleanly separated into three phases. The use of a centrifuge according to the present disclosure for the emulsion separation when obtaining hydrometals, such as cobalt, nickel, copper, therefore offers considerable advantages.

Other aspects of the present disclosure will become apparent from the following descriptions when considered in conjunction with the accompanying drawings.

DETAILED DESCRIPTION

Figure 1:
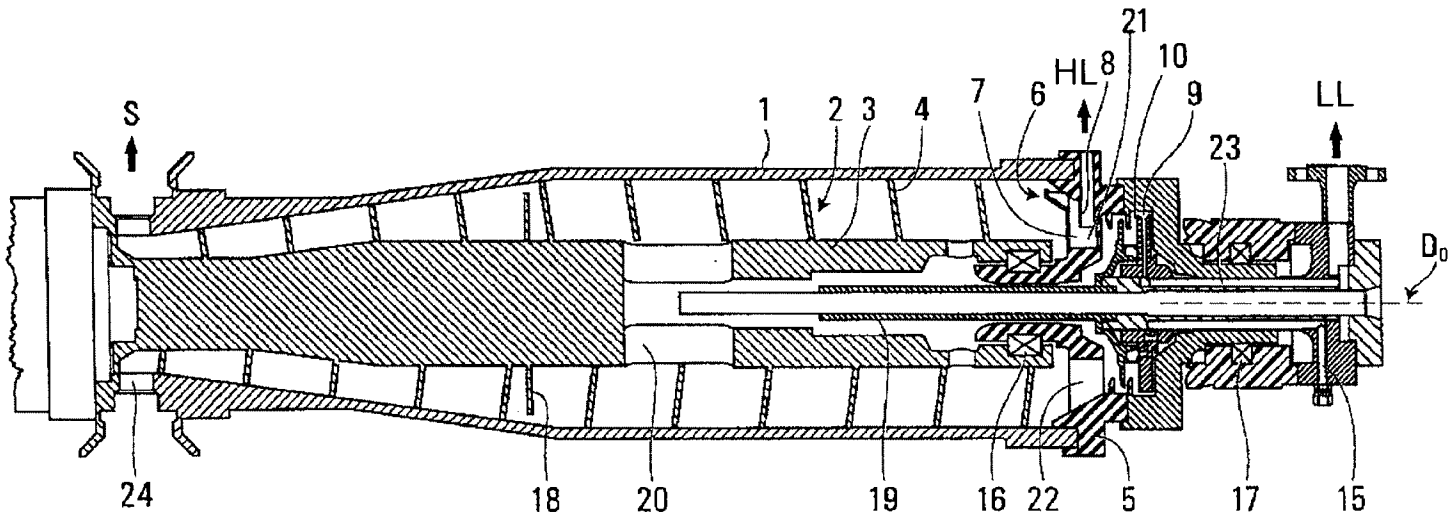
FIG. 1 is a sectional view of a first embodiment of a three-phase solid bowl screw centrifuge, according to the present disclosure.
Figure 5:
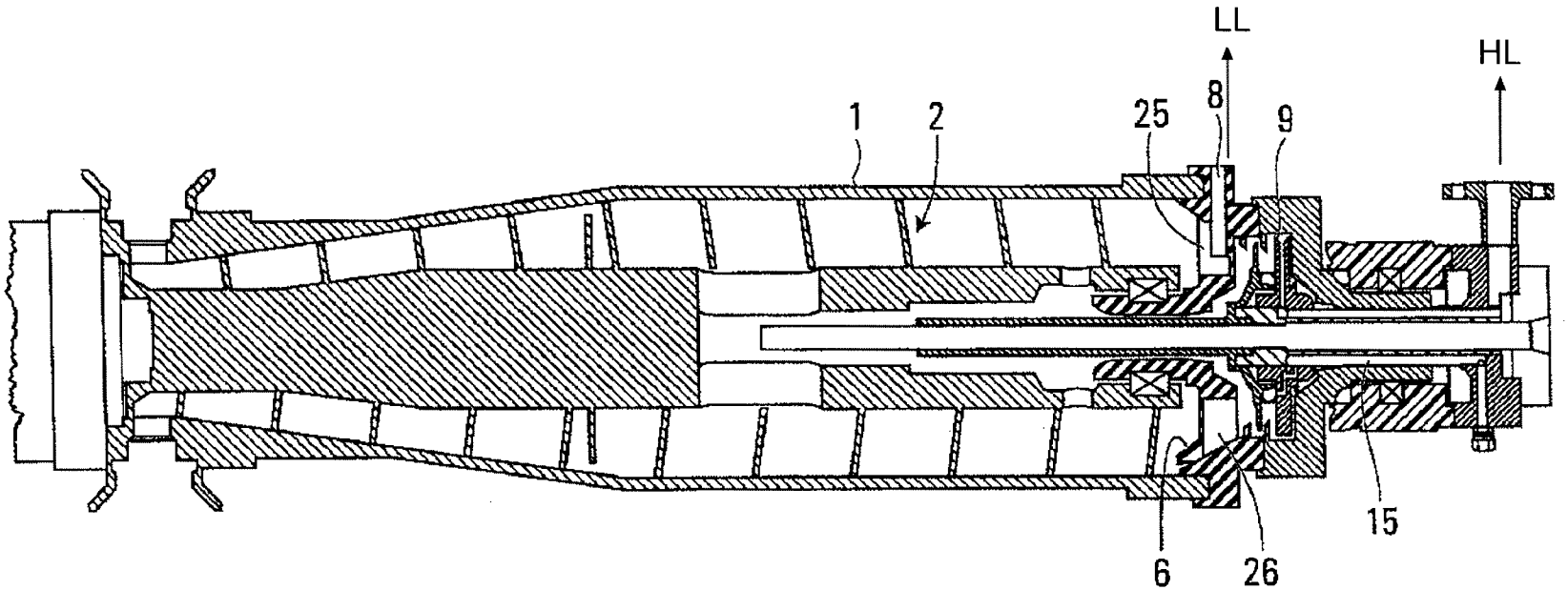
FIG. 5 is a sectional view of a second embodiment of a three-phase solid bowl screw centrifuge, according to the present disclosure.

FIGS. 1 and 5 illustrate parts of first and second embodiments of three-phase solid bowl screw centrifuges, according to the present disclosure, which have a rotatably disposed drum 1, for example, on bearings 17. Drum 1 has a horizontal axis of rotation and a rotatable screw 2 which is arranged in the drum 1. Screw 2 has a screw body 3 on which a circulating screw blade 4 is arranged. During an operation, the drum 1 and the screw 2 rotate at different rotational speeds n, m, respectively, about the same axis of rotation, as seen at diameter $D_0$ in FIG. 1. A bearing 16 is arranged between the drum 1 and the screw body 3. A second bearing of the screw 2 is situated on a solids discharge side (not shown).

Drum 1 as well as the screw 2 tapers at one of its ends, for example, conically. At the tapering end of the drum 1, a solids discharge 24 is arranged for a solid phase S transported to this end of the drum 1 by the screw 2. Two liquid phases, LL and HL, a lighter and a heavier density of a liquid phase, respectively, which can be mutually separated in a centrifugal field, are discharged from the drum 1 in an area of an opposite cylindrical end of the drum 1, which is closed by a drum lid 5.

For example, in a transition area to the tapering section, a baffle plate 18 can be arranged on the screw body 3.

Further, for example, an inlet pipe 19 extends from the cylindrical end of the drum 1 into the drum 1. This inlet pipe 19 leads into a distributing device 20 by way of which a product is guided into the drum 1.

The drum lid 5 has several breakthroughs or openings 21, 22 axially penetrating the drum lid 5. Preferably between four and eight such openings are formed on a circle of a defined diameter in the drum lid 5 and are distributed along the circumference.

Some of these openings, for example, first openings 21, are constructed in the form of recesses closed on one side, or, formed in the manner of pocket holes, and are used for discharging the heavier liquid phase HL. Other openings, for example, second openings 22. are used for discharging the lighter liquid phase LL.

For an implementation, a separating-plate-like separating weir 6 is disposed in front of some of the openings, for example, the first openings 21. The separating weir 6 is further developed and arranged such that only the heavy phase HL is discharged by way of an outer radius of this separating weir 6 in all provided operating conditions. In contrast, the second openings 22 have no such separating weir 6.

To this extent, the constructions of the embodiments of FIGS. 1 and 5 are essentially identical.

However, a difference between the embodiments of FIGS. 1 and 5 is that areas of the drum or decanter 1 arranged behind the first and the second openings 21, 22, 25, 26 are quasi "exchanged" in relation to the separating weir 6 which is situated in front of the openings leading to the centripetal pump, or skimmer disk 9.

This difference will be explained later herein.

According to FIG. 1, the heavier liquid phase HL, collecting radially farther to an outside of the drum 1, is guided by way of the separating weir 6 on the drum lid 5 into a discharge space 7 adjoining the separating weir 6 along a portion of a circumference of the separating weir 6. The discharge space 7 is formed by the openings 21 themselves. Discharge pipes 8, penetrating a drum shell, project into the discharge spaces 7. An inner radius, to which the respective discharge pipe 8 extends, also determines a discharge radius for the heavier liquid phase HL.

During the operation or during a running process, this discharge radius for the heavier phase HL is not variable. It can be changed or pre-adjusted when the drum 1 is stopped by exchanging the discharge pipe 8 or small tube for one of a different length.

In contrast, the discharge of the lighter liquid phase LL, after the passage through the second openings 22, takes place by centripetal pump, or skimmer disk 9. Skimmer disk 9 which is arranged in a skimmer chamber 10, or centripetal chamber, connected in front of the drum shell. The skimmer chamber 10 axially adjoins a drum interior and its inside diameter is equal to or, preferably, smaller than the inside diameter of the drum 1 in its cylindrical area. The light liquid phase LL is discharged from the drum through skimmer disk 9 and a discharge duct 23 adjoining this skimmer disk 9.

Figure 2:
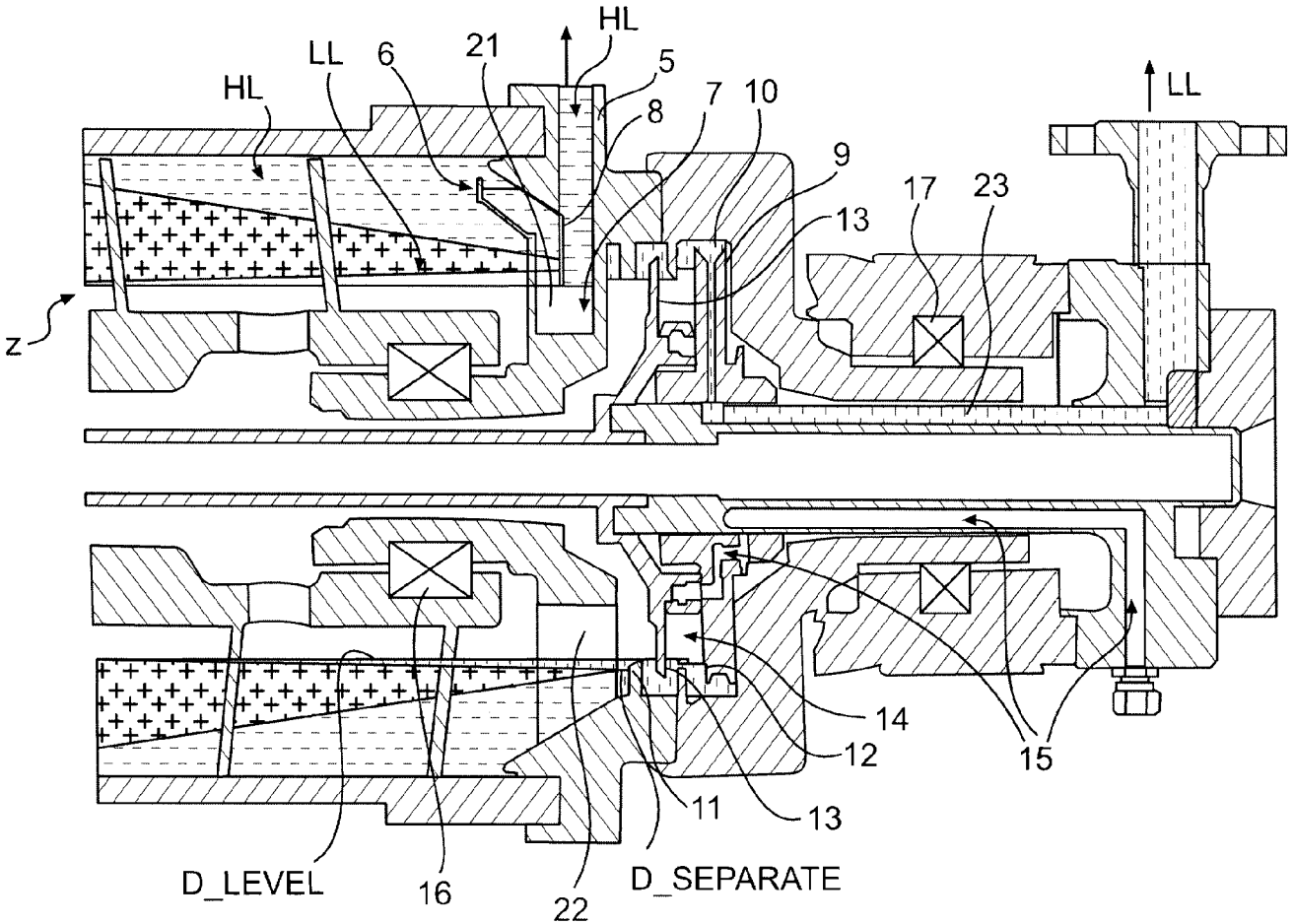
FIG. 2 is a schematic sectional view of a partial area of the solid bowl centrifuge of FIG. 1 in a first operating condition.
Figure 3:
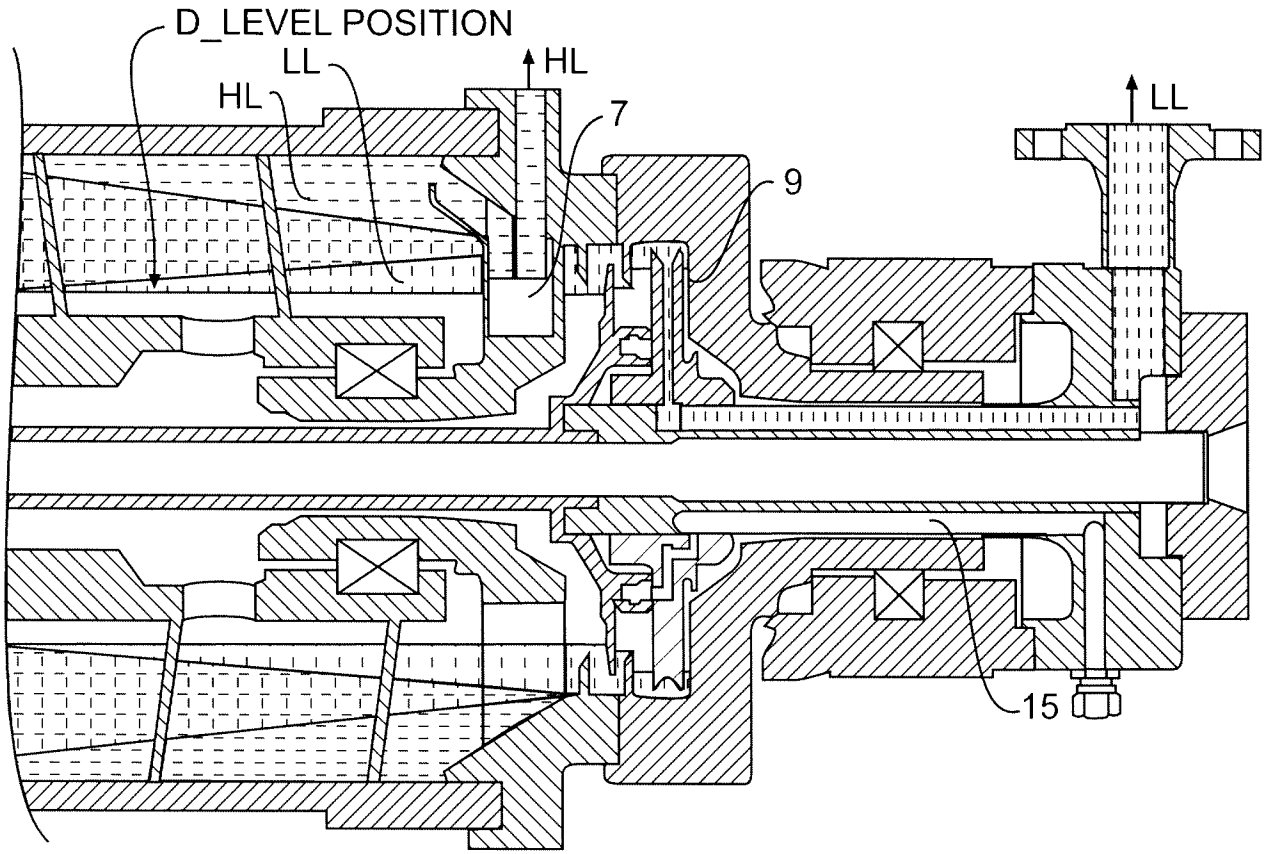
FIG. 3 is a schematic sectional view of a partial area of the solid bowl centrifuge of FIG. 1 in a second operating condition.

Toward the drum interior, see FIGS. 2 and 3, in the skimmer chamber 10, two regulating disks 11, 12, which may be of the same inside diameter are disposed in front of the skimmer disk 9. The regulating disks 11, 12 extend radially from an outside of the drum 1 toward an inside of the drum 1. A siphon disk 13 dips between these two regulating disks 11, 12 and extends in the skimmer chamber 10 from its inner circumference to the outside. The outside diameter of the siphon disk 13 is situated on a larger radius relative to the axis of rotation, at $D_o$, of the drum 1 than an inside diameter of the two regulating disks 11, 12.

The regulating disk 11 facing the separating weir 6 defines an overflow diameter for the light liquid phase LL.

An annular chamber 14 is formed during an operation and is located between the siphon disk 13 and the skimmer disk 9, which form axial boundaries for an axial area, and the annular chamber 14 is further located between an inner radius of the lighter liquid phase LL in this axial area and an inner shell or inner wall of the skimmer chamber 10 in this axial area.

A fluid feeding pipe 15, through which a fluid, such as a gas, can be guided from the outside of the drum 1 into the annular chamber 14, leads into this annular chamber 14.

In this manner, it becomes possible to change the pressure in the annular chamber 14, which also causes a change of the radius of the lighter liquid phase LL and thus has an effect on a separating diameter D_separate in the drum 1. It thereby becomes easily possible to influence two quantities: a pool depth, which is an inside radius of the drum 1 minus a radius at a line D_level position, for example, see FIG. 3; and, a separating zone Z between the lighter liquid phase LL and the heavier liquid phase HL. This is possible during the operation only by influencing or changing the pressure in the annular chamber 14.

As a result of the selection of the diameter of the regulating disks 11, 12 or their exchange, the overflow diameter of the lighter phase LL can be pre-adjusted.

When the pressure in the annular chamber 14 is increased, the liquid level to the center, or pool depth, rises in the interior of the drum 1. Analogously, a diameter of the separating zone Z is displaced farther toward the outside, for example, compare FIGS. 2 and 3.

As a result, a layer thickness of the lighter phase LL, for example, a broken vertical line, becomes greater and the flow-off velocity becomes lower, that is, a longer sedimentation time. The degree of clarification of the lighter phase LL is thereby increased or becomes better.

Since the separating zone Z moves toward the outside, the degree of clarification of the heavier phase HL, for example, a horizontal broken line, has the tendency to become poorer. The crosswise hatching indicates a mixed phase area or a separating zone Z area.

For the most part, the outflow pressure of the lighter phase LL, i.e., the skimmer disk 9 pressure can be varied independently of the chamber pressure.

When, for example, a concentration of the heavy phase HL, or mixed phase, increases, the pressure in the annular chamber 14 rises in order to shift the separating zone Z in the drum interior farther toward the outside to a greater radius. As a rule, this causes a greater layer thickness and a better degree of clarification of the lighter phase LL or a better phase separation.

Figure 4:
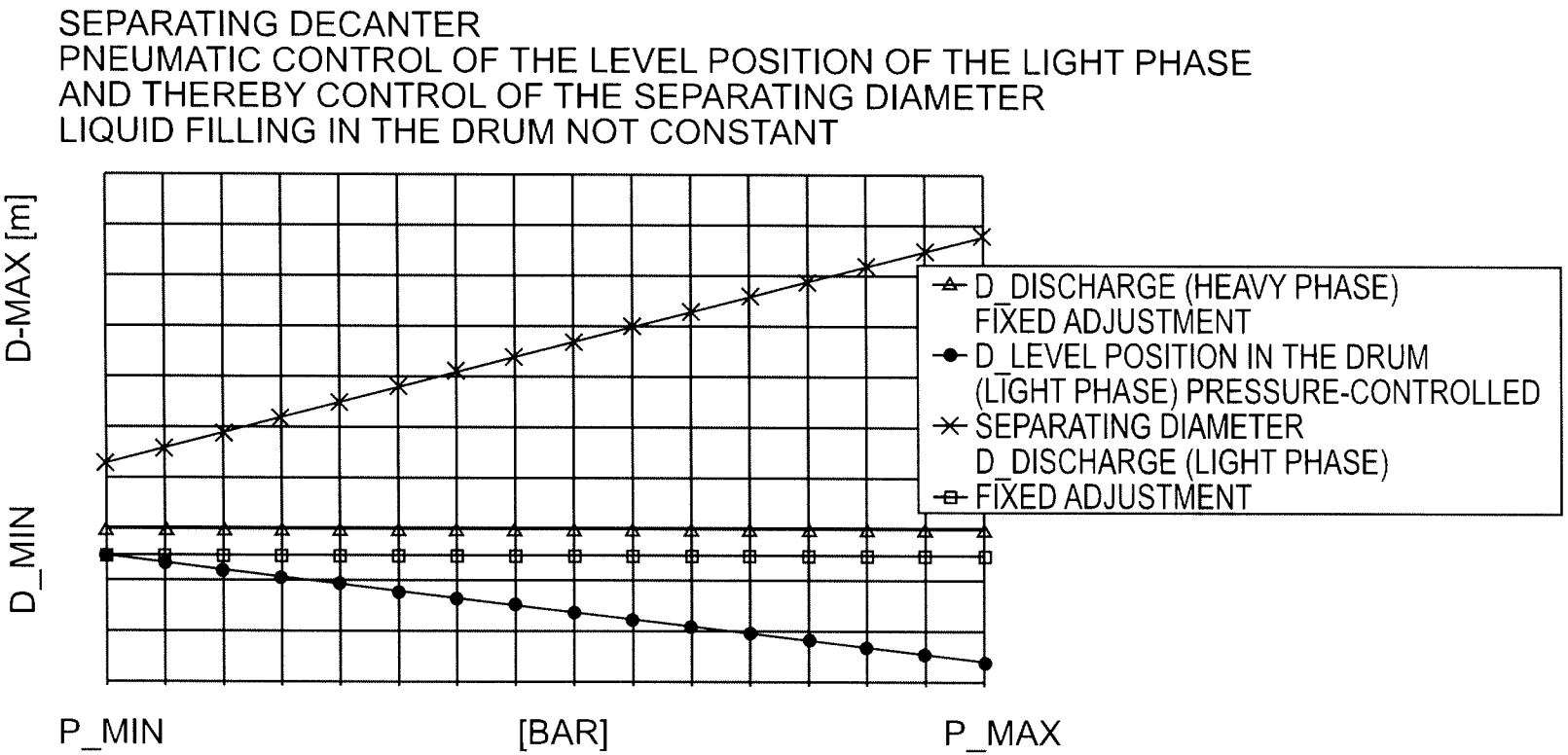
FIG. 4 is a diagram illustrating the operating behavior and the controllability of separating and clarifying processes by the solid bowl centrifuge of FIG. 1, according to the present disclosure.

The above-described behavior tendency is shown in the diagram of FIG. 4.

The diagram of FIG. 4 shows the diameters of the outflow for the light and the heavy liquid phases LL, HL, respectively. It also shows the D_level position in the drum 1, and the separating diameter D_separate, as a function of the pressure in the annular chamber 14.

The diagram of FIG. 4 shows the behavior at a constant rotational speed.

Because of the change of pressure, the liquid filling in the drum 1 is not constant. In each case, D indicates the diameter in the drum on both sides of the axis of rotation. Diameter D_pipes, that is, diameter discharge pipes and D_separating weir are each kept constant during the operation, although they are variable, for example, by an exchange. The inside diameter of the drum and the inside diameter of the solids discharge, as a rule, are also not variable by a conversion. The diameter on which the separating zone Z is situated, i.e., the separating diameter, increases with the pressure. In contrast, the liquid level D_level position falls inversely proportionally to the pressure.

FIGS. 2 and 3 schematically illustrate the conditions in the drum 1 at different pressures.

It is also conceivable to fixedly define a pressure in the annular chamber 14 during the operation and then achieve a change of the separating diameter D_separate in the drum 1 only by changing the rotational drum speed. This change of the rotational speed can take place, for example, as a function of a concentration measurement of the product inflow or outflow.

However, in the case of this type of control, the regulating range is smaller and can also only be used if a changing of the rotational drum speed during the operation is permissible. The diameter of the separating zone D_separate will then increase with the rotational speed (not shown).

FIG. 5 illustrates the second embodiment, according to the present disclosure. Here, the heavier liquid phase HL is discharged by way of the regulating disk arrangement, i.e., disks 12, 13 and the skimmer disk 9. The lighter liquid phase LL is discharged by way of the discharge pipe 8, which is achieved in that there the separating-plate-like separating weir 6 is arranged in front of the continuous two openings 26 which are open on both sides. The separating weir 6 thereby guides the heavy liquid phase HL to the skimmer disk 9, whereas the lighter phase LL is discharged by way of the discharge pipes 8 in the first openings 25, which are of a pocket hole type or are closed at one end.

In the annular chamber 14, the pressure thereby acts upon the heavier liquid phase HL.

Figure 6:
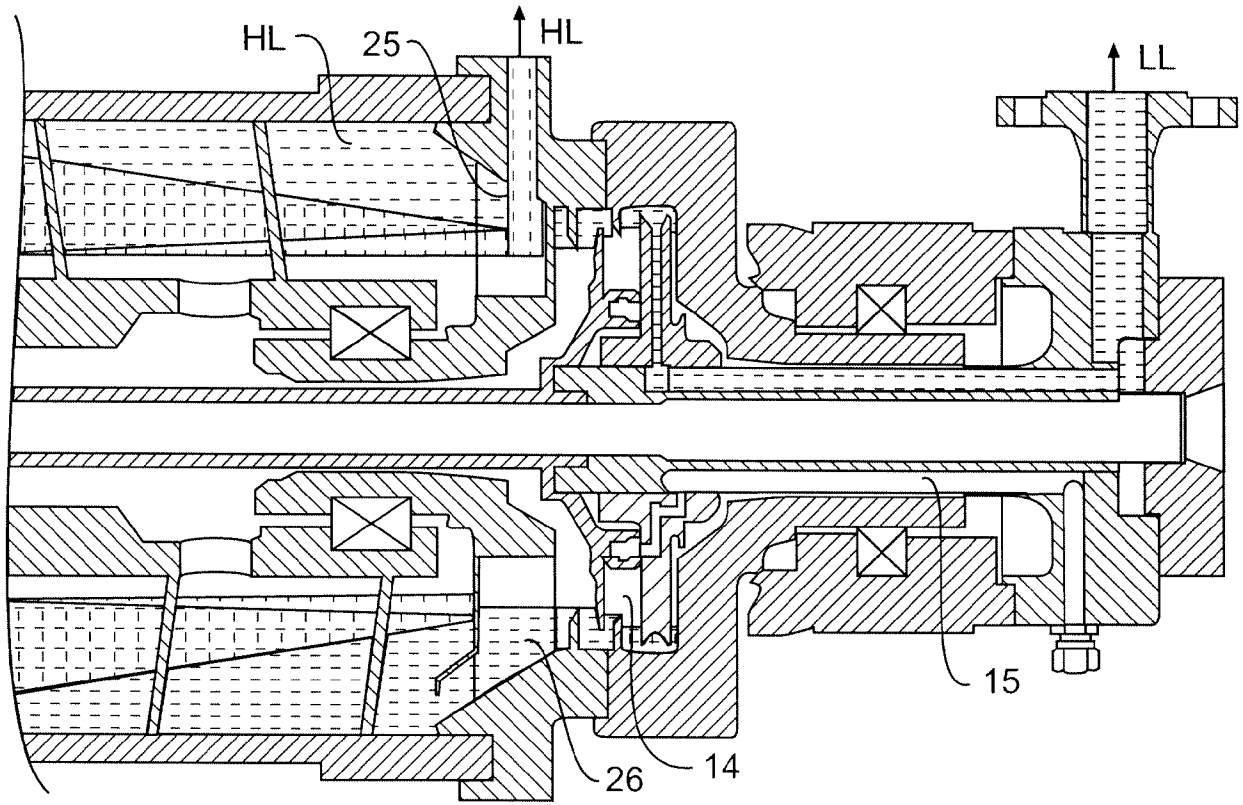
FIG. 6 is a schematic sectional view of a partial area of the solid bowl centrifuge of FIG. 5 in a first operating condition.
Figure 7:
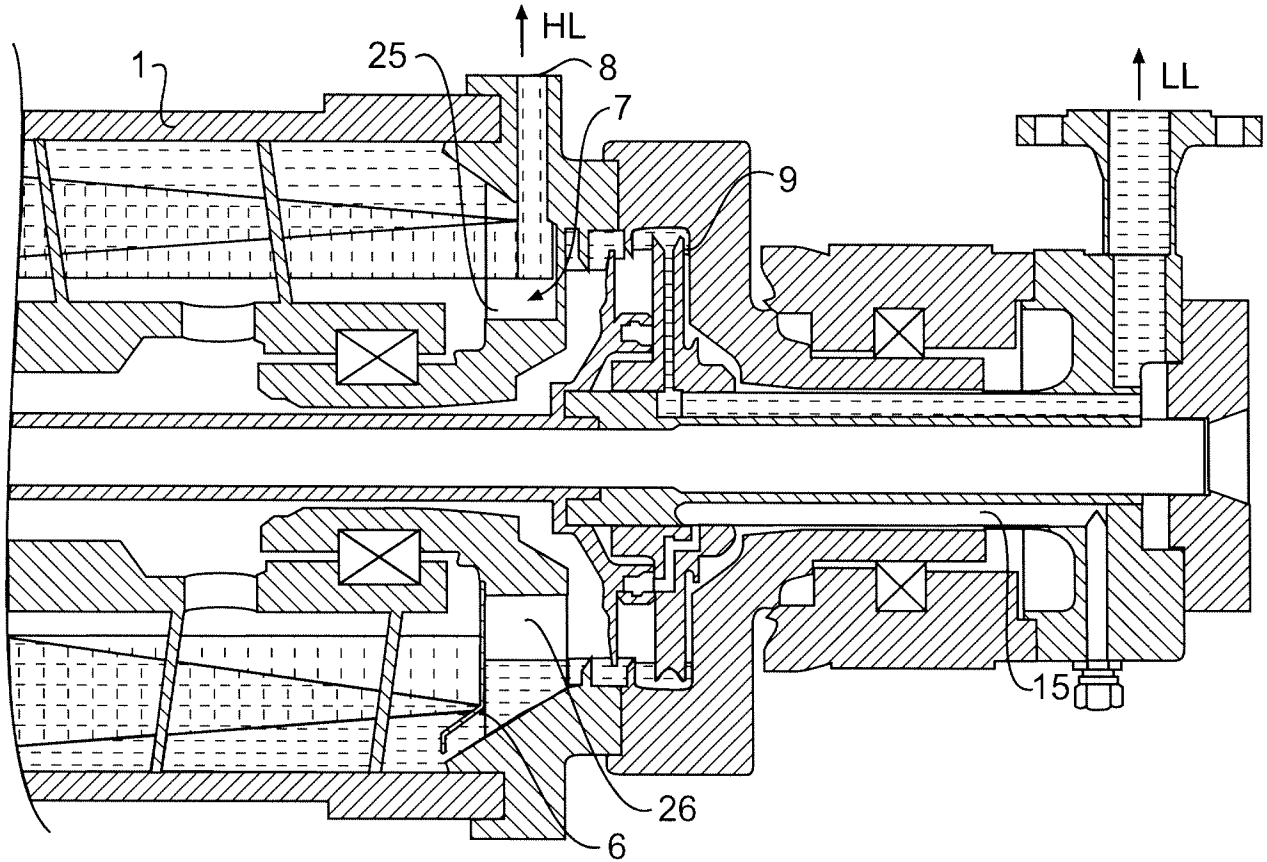
FIG. 7 is a schematic sectional view of a partial area of the solid bowl centrifuge of FIG. 5 in a second operating condition.

When the pressure in the annular chamber 14 is increased in the embodiment of FIG. 5, on the drum side of the siphon disk 13, the inside diameter of the heavier phase HL shifts to the center, and the separating zone diameter shifts farther toward the interior or is reduced. This has the result that the layer thickness of the lighter phase LL becomes smaller and that the outflow velocity is increased. The degree of clarification of the lighter phase LL is thereby reduced. FIG. 6 shows the higher-pressure condition, and FIG. 7 shows the condition after a lowering of pressure in the annular chamber 14.

Since the separating zone Z moves farther toward the inside, in contrast, the degree of clarification of the heavier phase HL becomes better.

The concentration distribution of any of the discharged phases, for example, is preferably used as the controlled variable.

When, for example, the pressure of the heavy liquid phase HL rises in the light liquid phase LL, the pressure is reduced in order to shift the separating zone Z in the drum interior farther toward the outside to a larger radius. As a rule, this causes a larger layer thickness and a better degree of clarification of the lighter phase LL.

Figure 8:
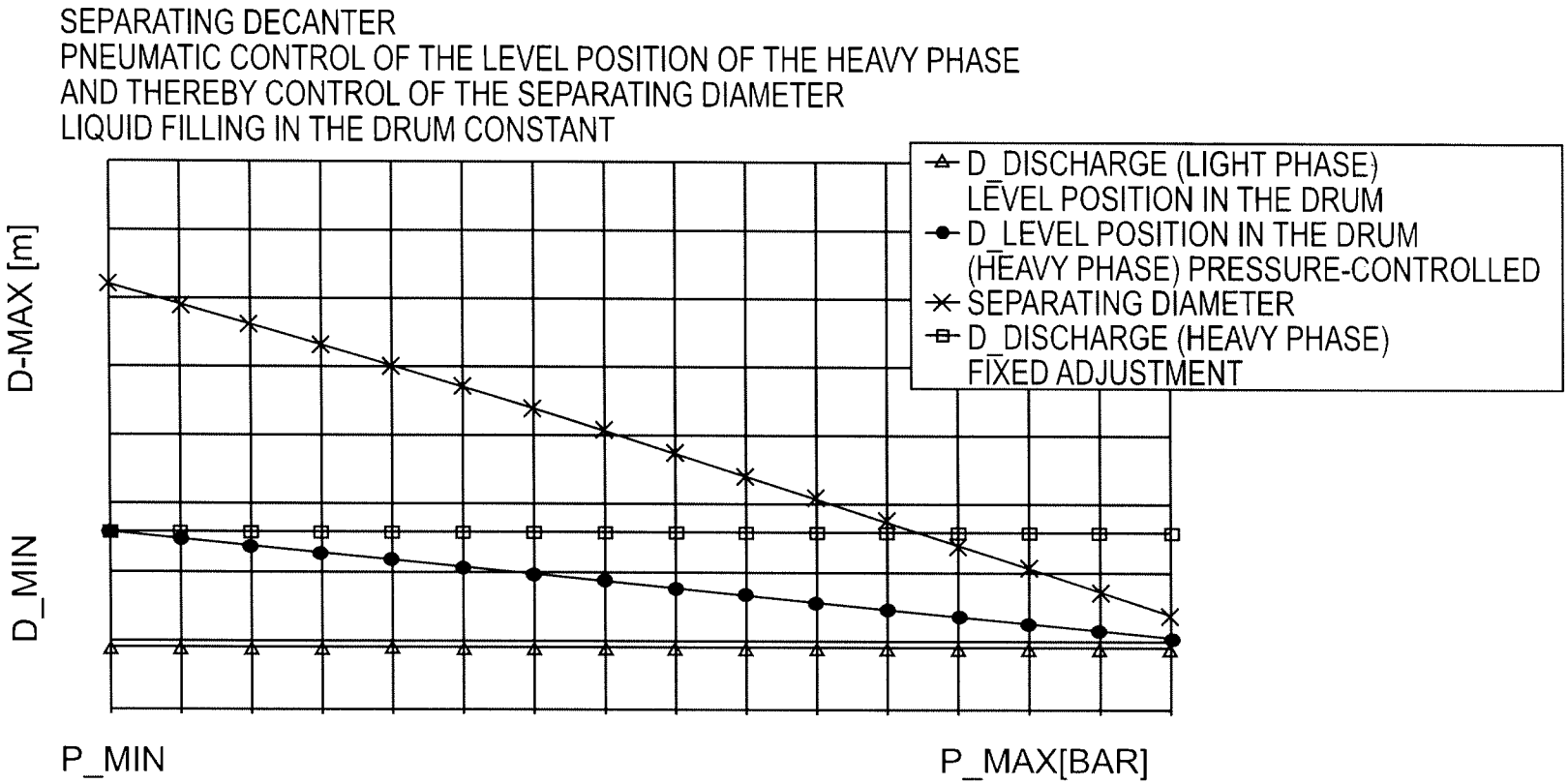
FIG. 8 is a diagram illustrating the operating behavior and the controllability of separating and clarifying processes by the solid bowl centrifuge of FIG. 5, according to the present disclosure.

FIG. 8 illustrates the corresponding control behavior by an example analogous to FIG. 4. The different diameters are again entered as a function of the pressure in the annular chamber 14.

Here, it is also conceivable to fixedly define a pressure in the annular chamber 14 during the operation and to achieve a change of the separating diameter in the drum I solely by changing the rotational speed of the drum 1. This change of the rotational speed can take place, for example, as a function of a concentration measurement of the product inflow or outflow.

However, in the case of this type of the control, the control range is smaller and can also be used only when a changing of the rotational drum speed during the operation is permitted.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A three-phase solid bowl screw centrifuge comprising:
- a rotatable drum;
- a screw arranged in the drum;
- a solid material discharge located at a first axial end of the drum;
- two liquid outlets located at a second axial end of the drum, a first of the liquid outlets being for a lighter liquid phase and a second of the liquid outlets being for a heavier liquid phase;
- one of the liquid outlets including a skimmer disk arranged in a skimmer chamber and the other of the liquid outlets formed as an overflow;
- two regulating disks located in front of the skimmer disk and which disks extend radially from an outside of the drum toward an inside of the drum;
- a siphon disk extends radially outwardly from an interior circumference of the skimmer chamber to an exterior circumference of the skimmer chamber, the siphon disk extending between the regulating disks and into the skimmer chamber, the skimmer chamber opening radially inwardly toward the inside of the drum;
- an annular chamber is formed during an operation and is located between the siphon disk and the skimmer disk, the siphon and skimmer disks acting as axial boundaries for an axial area, and the annular chamber is further located between an inside radius of the lighter liquid phase in the drum and an inner wall of the skimmer chamber in the axial area; and
- a fluid feed pipe leading into the annular chamber to change a pressure on the annular chamber and to change at least one of a separation zone between the lighter and heavier phases and a pool depth in the drum.

2. Three-phase solid bowl screw centrifuge according to claim 1, wherein the first and second liquid outlets are axial openings in a drum lid, and a separating-plate-type separating weir is assigned to one of the first and axial second openings.

3. Three-phase solid bowl screw centrifuge according to claim 2, wherein one or more of the openings is constructed as a chamber, or a pocket hole closed at one axial end.

4. Three-phase solid bowl screw centrifuge according to claim 2, wherein the separating weir is situated such that the heavier liquid phase is guided by way of the separating weir into at least one discharge space in which at least one discharge pipe penetrating the drum shell is inserted as the overflow.

5. Three-phase solid bowl screw centrifuge according to claim 2, wherein an arrangement of the separating weir is such that the lighter liquid phase is guided to the skimmer disk during the operation.

6. Three-phase solid bowl screw centrifuge according to claim 2, wherein an arrangement of the separating weir is such that the lighter liquid phase is guided into the discharge space, in which a discharge pipe penetrating the drum shell is inserted as the overflow.

7. Three-phase solid bowl screw centrifuge according to claim 2, wherein an arrangement of the separating weir is such that the heavier liquid phase is guided to the skimmer disk during the operation.

8. Three-phase solid bowl screw centrifuge according to claim 1, wherein the skimmer chamber axially adjoins a drum interior, and an inside diameter of the skimmer chamber is smaller than the inside diameter of the drum in a cylindrical area of the drum, and the two regulating disks and the siphon disk are disposed in front of the skimmer disk in the skimmer chamber.

9. Three-phase solid bowl screw centrifuge according to claim 1, further including at least two first liquid outlets and two second liquid outlets, each of the outlets formed as axial openings and arranged in a drum lid in a circular fashion and distributed along a circumference, of the drum lid, and a separating weir is assigned to each second opening.

10. The centrifuge of claim 1, wherein the two regulating disks have identical inside diameters.

11. The centrifuge of claim 1, wherein the skimmer chamber axially adjoins a drum interior and an inside diameter of the skimmer chamber is equal to the inside diameter of the drum in a cylindrical area of the drum, and in the two regulating disks and the siphon disk are disposed in front of the skimmer disk in the skimmer chamber.

12. A method of operating a three-phase solid bowl centrifuge, the method steps comprising:
- providing a three-phase solid bowl centrifuge including
  - a rotatable drum;
  - a screw arranged in the drum;
  - a solid material discharge for a solid phase located at a first axial end of the drum;
  - two liquid outlets located at a second axial end of the drum, a first of the liquid outlets being for a lighter liquid phase and a second of the liquid outlets being for a heavier liquid phase;
  - one of the liquid outlets including a skimmer disk arranged in a skimmer chamber and the other of the liquid outlets formed as an overflow;
  - two regulating disks located in front of the skimmer disk and which disks extend radially from an outside of the drum toward an inside of the drum;
  - a siphon disk extends radially outwardly from an interior circumference of the skimmer chamber to an exterior circumference of the skimmer chamber, the siphon disk extending between the regulating disks and into the skimmer chamber, the skimmer chamber opening radially inwardly toward the inside of the drum;
  - an annular chamber is formed during in operation and is located between the siphon disk and the skimmer disk, the siphon disk and skimmer disks acting as axial boundaries for an axial area, and the annular chamber is further located between an inside radius of the lighter liquid phase in the axial area and an inner wall of the skimmer chamber in the axial area;

a fluid feed pipe leading into the annular chamber to change a pressure on the annular chamber and to change at least one of a separation zone between the lighter and heavier phases and a pool depth in the drum;

operating the centrifuge in a separating operation; and controlling the separating operation by changing a pressure in the annular chamber or by changing the rotational speed of the drum.

13. The method according to claim 12, wherein the controlling of the separating operation is by changing the rotational speed of the drum.

14. The method according to claim 12, wherein the controlling of the separating operation in the drum is a function of the concentration distribution in at least one of the phases.

15. The method of claim 12, wherein the separating operation includes an emulsion which is formed when obtaining hydrometals.

16. The method of claim 15, wherein the hydrometals include cobalt, metal and copper.

* * * * *